US006216958B1

(12) United States Patent
Unbehaun

(10) Patent No.: US 6,216,958 B1
(45) Date of Patent: Apr. 17, 2001

(54) RAILWAY TRACK AND SLEEPER AND GAP-COVERING ELEMENT THEREFOR

(76) Inventor: Olaf Unbehaun, Fabrikstrasse 75, D-66539 Neunkirchen (DE)

( * ) Notice: Subject to any disclaimer, the term of this patent is extended or adjusted under 35 U.S.C. 154(b) by 0 days.

(21) Appl. No.: 09/125,594

(22) PCT Filed: Feb. 17, 1997

(86) PCT No.: PCT/DE97/00296

§ 371 Date: Aug. 21, 1998

§ 102(e) Date: Aug. 21, 1998

(87) PCT Pub. No.: WO97/31154

PCT Pub. Date: Aug. 28, 1997

(30) Foreign Application Priority Data

Feb. 21, 1996 (DE) ..... 196 06 469
Apr. 18, 1996 (DE) ..... 196 15 330

(51) Int. Cl.[7] ..... E01B 3/00
(52) U.S. Cl. ..... 238/27; 238/29; 238/62
(58) Field of Search ..... 238/2, 3, 5, 6, 238/7, 8, 27, 29, 59, 62

(56) References Cited

U.S. PATENT DOCUMENTS

| | | | | |
|---|---|---|---|---|
| 894,360 | * | 7/1908 | Barnum | 238/6 |
| 957,841 | * | 5/1910 | Blair | 238/6 |
| 1,189,652 | * | 7/1916 | Alexander | 238/6 |
| 1,214,245 | * | 1/1917 | Waples | 238/6 |
| 1,704,545 | | 3/1929 | Petterson . | |
| 3,760,544 | | 9/1973 | Hawes et al. . | |
| 3,939,617 | * | 2/1976 | Eisses | 52/166 |
| 4,106,694 | * | 8/1978 | Salvino | 238/10 C |
| 4,229,497 | | 10/1980 | Piazza . | |

FOREIGN PATENT DOCUMENTS

| | | | | |
|---|---|---|---|---|
| 2244 007 | | 1/1974 | (DE) . | |
| 86 18206 | | 11/1986 | (DE) . | |
| 38 20 390 | | 12/1989 | (DE) . | |
| 677376 | | 3/1930 | (FR) . | |
| 966162 | * | 5/1948 | (FR) | 238/2 |
| 966162 | * | 10/1950 | (FR) | 238/2 |
| 1489371 | | 7/1967 | (FR) . | |
| WO7900031 | | 1/1979 | (WO) . | |

* cited by examiner

*Primary Examiner*—Russell D. Stormer
*Assistant Examiner*—Frantz F. Jules
(74) *Attorney, Agent, or Firm*—Rabin & Champagne, PC

(57) ABSTRACT

On a railway track comprising a ballast bed (10), sleepers (12) provided on the ballast bed and tracks (14) mounted on the sleepers, the sleepers are disposed closely adjoining one another but out of mutual contact, leaving a gap, the sleepers defining drainage channels (134) extending transversely to the longitudinal direction of the track for lateral water drainage. The gaps between the sleepers may be covered by covering elements (142) or the sleepers may overlap without touching one another. In this manner the track bed is substantially kept free of water, the positional stability of the track is increased, therefore reducing or rendering superfluous the normally required maintenance work such as tamping as well as cleaning and weed control.

33 Claims, 17 Drawing Sheets

RAILWAY TRACK AND SLEEPER AND GAP-COVERING ELEMENT THEREFOR

BACKGROUND OF THE INVENTION

The invention relates to a railway track comprising a ballast bed, sleepers disposed on the ballast bed and rails mounted on the sleepers. The invention further relates to a sleeper for such a railway track as well as a gap cover for covering the gap between such sleepers.

Sleeper according to the state of the art, may be manufactured of wood. Concrete or steel, concrete sleepers of the German type B70 are at present most frequently installed, the axial spacing of the sleepers being 60 cm with a maximum sleeper width of 30 cm.

This track system, conceived to be durable, is exposed to all sorts of weather conditions and requires constant maintenance. The very high maintenance costs include lifting, tamping and realigning the track in the event of positional shifts, cleaning the track in the event of severe soiling and eradication of plant growth in the ballast bed.

SUMMARY OF THE INVENTION

It is the object of the invention to so further develop a railway track of the type mentioned in the opening paragraph that the upkeep costs may be minimized and investments in respect of earthwork may be reduced.

The object is essentially attained in that adjoining sleepers are disposed in a longitudinal direction of the track closely adjoining one another but without mutual contact, leaving a gap therebetween. At least one drainage channel extends transversely to the longitudinal direction of the track which is assigned to each sleeper for lateral water drainage.

These expedients entail multiple advantages.

Due to the enlargement of the support surface of the sleepers on the ballast, the surface pressure onto the ballast is reduced. Because of the increase of the inherent weight of the sleeper and the enlargement of the front surfaces, i.e. the end faces of the sleepers, the resistance to transverse displacement is increased. By draining the surface water via the drainage channel at least a major part of the surface water is kept away from the load-bearing substructure.

Because of the lower surface pressure, the higher resistance to transverse displacement and the drainage of surface water, the positional stability of the track is increased considerably. This entails at the same time load reduction for the substructure, i.e. the necessary investments in earthwork are minimized.

By reducing loads on the ballast and thus likewise the substructure and by reducing the penetration of surface water into the track grid the surface water is on the one hand to a large extent kept away from the load-bearing substructure underneath the ballast bed, thus making it possible to avoid or reduce a softening of the substructure and thus a destabilization of the entire track. Furthermore plant growth in the ballast bed is practically entirely prevented due to the ballast bed being covered completely or at least almost completely by the sleepers and the side-way drainage of the surface water so that in these regards expensive maintenance operations for the cross-section covered by the sleepers may be dispensed with. In addition, the safety-related requirements are met so that in the outer regions of the sleeper (shoulder) only a considerably simplified vegetation care is still necessary. Soiling of the ballast bed is likewise practically entirely excluded and the expensive cleaning of the ballast bed may thus likewise be dispensed with.

The size of the gap provided for between adjoining sleepers is so selected that radial laying of the sleepers in the region of curves in the section is possible, preferably without the sleepers touching one another in these regions.

The drainage channels may in principle be designed horizontally, that is to say parallel to the longitudinal axis of the sleepers; a more reliable and quicker drainage is, however, ensured if the drainage channels according to a further feature of the invention are designed inclined in the longitudinal direction of the sleepers. If the transverse inclination of the drainage channels is greater than the maximum superelevation of the track in the region of curves, the water, even in the region of superelevations, may always be drained reliably towards the outside, that is to say in two-tracked sections towards the field side.

It is particularly advantageous if the drainage channels comprise two sections inclined in opposite directions for lateral water drainage in the direction towards both sleeper heads, in which context the transverse inclination of the drainage channels may in this case be particularly strong with the result that even in the event of considerable track superelevations a reliable drainage is possible. In addition, the sleepers may then be designed symmetrically.

In a preferred embodiment of the invention, the upper sides of the sleepers are at least partly designed to be inclined in the longitudinal direction of the track, that is to say towards the drainage channels. This ensures a rapid and reliable drainage and the permanent deposition of dirt on the sleeper is simultaneously drastically reduced as the sleepers are rinsed clean after heavy rainfalls and the dirt is discharged sideways via the drainage channels.

In order to prevent water from penetrating the ballast bed via the gap between the sleepers, a gap cover is provided according to a further important aspect of the invention. This gap cover may comprise a covering element bearing on adjoining sleepers at both ends of the gap and may in the simplest case be designed as a cover plate, for example even a concrete panel. The gap cover may, however, also be fitted in form-fitting and/or press-fitting engagement and, where appropriate, be adhesively bonded into in the gap or in the region of the gap. The gap cover may consist of a suitable plastics material, of rubber or rubber-like material or it might be formed of foaming material similar to canned foam or it might also be in the form of an elastically compressible strip of suitable synthetic resin which is fitted into the gap. It is important for the gap cover to be able to seal gaps of different width or gaps of changing width, as in the region of curves in the track the sleepers are laid radially and the width of the gaps thus varies from one sleeper face to the other.

In cross-section the gap cover preferably comprises a roof section covering the gap as well as a section of the sleepers bordering thereon, wide enough to reliably cover the gap even if the maximum gap width occurs. The gap cover may furthermore comprise a foot section projecting downwardly into the gap, which may be narrower than the minimum gap width occurring and which prevents a lateral sliding of the gap cover. Advantageously this foot section in the gap is fitted in press-fitting or form-fitting relationship. This may in particular be attained in that at the foot section holding means are provided which adapt to the respective gap width and which are preferably elastically deformable and which may be designed in particular as expansion elements extending transversely to the gap. After laying the sleepers these holding means are pressed into the gap until the roof section comes to rest on the sleepers, in which case the expansion elements are bent or folded upwardly to a greater or lesser extent, thus anchoring themselves in the gap.

If designed appropriately, the gap cover may perform as a fluid-tight seal.

Each sleeper may be provided with one or more drainage channels in order to drain the surface water of any sleeper sideways. In a preferred embodiment of the invention, however, a joint drainage channel is assigned to any two adjoining sleepers. This may for example be attained in that between adjoining sleepers a gutter is provided, the adjoining sleepers being able to cover the gutter from both sides.

In a particularly preferred further development of the invention provision is made, however, that adjoining sleepers overlap in longitudinal direction of the track without mutual contact and that the drainage channel in the region of overlap is preferably designed to form an integral part of one of the two adjoining sleepers.

In particular, each sleeper may for this purpose comprise along its one longitudinal side a flashing-like projection and along its opposite longitudinal side a laterally protruding channel section forming the drainage channel, the channel section engaging under the flashing-like projection of the adjoining sleeper. In this case sleepers may be used which are altogether identical.

Alternatively, sleepers of a first type and sleepers of a second type are provided alternatingly, in which context each sleeper of the first type in each case comprises a flashing-like projection along its two opposite longitudinal sides and in which context each sleeper of the second type comprises a laterally protruding channel section forming the drainage channel along its two opposite longitudinal sides, each channel section engaging underneath the flashing-like projection of the adjoining sleeper.

In a preferred further embodiment of the invention the upper sides of the sleepers are designed with an incline, at least partly in longitudinal direction of the track, that is to say towards the drainage channels. This ensures a quick and reliable drainage and the permanent deposit of dirt on the sleeper is at the same time drastically reduced as the sleepers are rinsed clean after heavy rainfalls and the dirt is flushed sideways via the drainage channels.

In order to ensure that the water flowing from the upper side of the sleeper towards the drainage channel of the adjoining sleeper actually reaches the drainage channel, a drip section is provided in an advantageous further development of the invention at the end of the flashing projections of the sleepers along the underside of these projections, formed either by a dripping ledge pointing downwardly or by a notch pointing upwardly.

According to a particularly preferred feature the invention provides that the track supports of the sleepers are arranged off-centre in relation to the longitudinal centre plane of the sleepers, in particular that they areoffset rearwardly in relation to the direction of travel of the track thus allowing for the forces of vehicle movement dynamics conveyed to the sleepers via the tracks by the vehicle axes.

According to a further advantageous feature of the invention a recess is provided on the underside of the sleeper, in particular arranged centrally and extending over the entire sleeper width, forming a substantially non-loadbearing zone for the sleeper in the region of this recess, preventing "riding" and therefore possible fracture of the sleeper. Preferably this recess is filled with a deformable synthetic resin material, e.g. foam plastic, which is adequately resilient to not assume a load-bearing function as compared with concrete but which, on the other hand, substantially prevents the penetration of the ballast into the recess, for example in a tamping process.

The sleepers will advantageously consist of reinforced concrete, if required, they may, however, also be manufactured of a plastics material, in particular a recycled plastics material which would substantially reduce the weight of the sleepers. In the case of concrete sleepers, the sleepers, for the purpose of weight reduction, may comprise at least one cavity which may be filled in particular with plastics material.

On or in the sleeper a duct passage may advantageously be provided extending in longitudinal direction of the track and in which a track conductor may be inserted and mounted by suitable fastening means.

It may further be advantageous to form a depression or projection at the sleeper heads, the depression or projection either being formed by the concrete itself or by reinforcing rod spacers, sockets or the like cast into the concrete. Such depressions on both opposite sleeper heads may be of advantage in particular for assembly purposes or for lifting the sleepers for tamping purposes. Concrete-embedded concrete rod spacers or assembly sleeves may serve to mount additional components on the sleepers, for example sleeper-covering sound protection means in the form of walls or the like extending parallel to the tracks.

In order to reduce the sound level of the track according to the invention, the surface of the sleepers, in a preferred further embodiment of the invention, may be provided, at least in part, with sound refracting means, such as in particular sound refracting structures, for which purpose the sleeper surface, with the exception of the gutter, may for example be provided with a rhombic structure or for which purpose a suitable facing material may be used when casting the sleeper, similar, for example, to exposed aggregate concrete.

In order to facilitate tamping, in particular in the region of points, it may be advantageous to provide tamping apertures in the sleeper in mutually opposing positions, preferably in pairs, in relation to the longitudinal axis of the sleeper and through which the tamping element of the tamping device may engage the ballast. It may further be advantageous to provide continuous filling apertures in the sleeper via which additional filling material may be introduced into the ballast bed.

According to a further aspect of the present invention the drainage channel at the face end of the sleeper exits into a further drainage channel extending in the longitudinal direction of the track, and preferably forming an integral part of the sleeper at the sleeper head. In this manner, the transversely drained water, for example in the region of bridges, may additionally be guided over a certain distance in longitudinal direction of the track. The gap between the further drainage channels extending in longitudinal direction of the track, occurring between adjoining sleepers, may be closed by the gap cover discussed further above.

According to a further aspect of the present invention, the drainage channel at the face end of the sleeper comprises an upwardly directed retaining wall and the gap between adjoining retaining walls of adjoining sleepers may likewise be sealed by the said gap cover. In this manner a water collecting chamber is brought about between adjoining sleepers in which water accumulates when it rains, which may then evaporate or be whirled up and dissipated by passing trains.

In accordance with a further aspect of the invention adjoining sleepers may define between one another a single drainage channel, in which case each sleeper is assigned approximately half a drainage channel and the gap between the sleepers may be sealed by an appropriate gap sealing means.

BRIEF DESCRIPTION OF THE DRAWINGS

Further advantageous characteristics of the invention are apparent from the remaining subsidiary claims as well as from the following description in which several working examples of the invention are described in detail with reference to the drawing. There are shown in the drawing, partly in schematic or semi-schematic illustration:

DETAILED DESCRIPTION OF THE INVENTION

Figure 1:
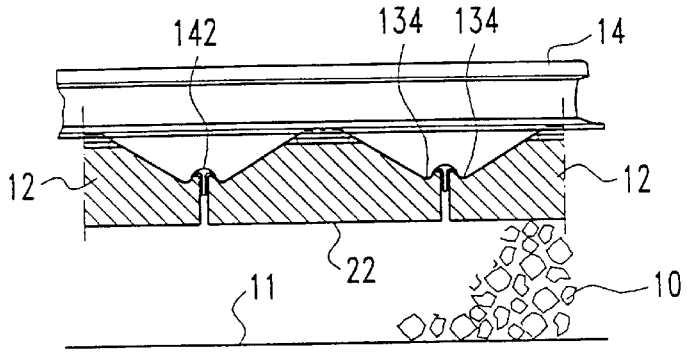
FIG. 1 a schematic, partly sectionalized side elevation of a portion of a first embodiment of a railway track according to the invention, FIG. 2 a plan view of the track according to FIG. 1, FIG. 3 a side elevation of the longitudinal sleeper sides according to FIG. 1, FIG. 4 a section through a sleeper according to FIG. 1 in an enlarged view, FIG. 5 a section through the gap region of two adjoining sleepers including the cover element, FIGS. 6 to 9 section sketches similar to FIG. 5 with varying gap widths, FIG. 10 a schematic side elevation of a portion of a further embodiment of a railway track according to the invention, FIG. 11 a plan view of the track according to FIG. 10, FIG. 12 a side elevation of the longitudinal side of the sleepers according to FIG. 10, FIG. 13 a schematic side elevation of a portion of a further embodiment of a railway track according to the invention, FIG. 14 a plan view of the track according to FIG. 13, FIG. 15 a partly sectionalized side elevation of the longitudinal side of the sleepers according to FIG. 13, FIG. 16 an elevation of a sleeper according to FIG. 13 in an enlarged view, FIG. 17 a schematic side elevation of a portion of a further embodiment of a railway track according to the invention, FIG. 18 a plan view of the track according to FIG. 17, FIG. 19 a partly sectionalized side elevation of the longitudinal side of the sleepers according to FIG. 17, FIG. 20 a side elevation of the sleepers according to FIG. 1 in an enlarged view in relation to FIG. 1, FIG. 21 a schematic side elevation of a portion of a further embodiment of a railway track according to the invention, FIG. 22 a schematic side elevation of a portion of a first embodiment of a railway track according to the invention, FIG. 23 a plan view of the track according to FIG. 22, FIG. 24 a side elevation of the longitudinal side of the sleepers according to FIG. 22, FIG. 25 a section through the sleeper according to FIG. 22 in an enlarged view, FIG. 26 a view similar to FIG. 25, a plurality of sections, staggered in the longitudinal direction of the sleeper, being indicated in order to illustrate the inclination of the sleeper surface and of the drainage channel, FIG. 27 a section similar to FIG. 25 of a second embodiment with off-centre track supports, FIG. 28 a partly sectionalized side elevation similar to FIG. 22 of a further embodiment comprising additional filling apertures, FIG. 29 a plan view of the working example according to FIG. 2, FIG. 30 a sectionalized view of the sleepers according to FIG. 28, FIG. 31 a side elevation similar to FIG. 22 of a further embodiment comprising additional tamping apertures, FIG. 32 a plan view of the working example according to FIG. 31, FIG. 33 a sectionalized view of the sleepers according to FIG. 31, FIG. 34 a side elevation similar to FIG. 22 of a further working example, FIG. 35 a plan view of the working example according to FIG. 34, FIG. 36 a sectionalized view of the sleepers according to FIG. 34, FIG. 37 a schematic side elevation of a further working example in which the sleepers of a first and second construction type are alternately disposed and FIG. 38 a schematic side elevation of a further working example in which separate drainage channels are disposed between adjoining sleepers.

Firstly reference is made to the first working example according to FIGS. 1 to 9. The railway track there shown comprises a ballast bed 10, rest on a substructure 11, transverse sleepers 12 resting on the ballast bed and tracks 14 mounted on the sleepers 12 by means of conventional mounting elements (tensioning clamps) (not illustrated). For this purpose track supports 16 are provided on the sleepers 12 as well as sleeper bolts 18 including engagement grooves 20 for the tensioning clamps. In the case of the working example the spacing of the sleeper axes is 60 cm which corresponds to the presently customary standard spacing of a transverse sleeper track. The sleepers 12 are, however, much wider than the conventional sleepers (30 cm) and the gap between adjoining sleepers is of the order of from a few millimeters to a few centimeters.

Each sleeper comprises a substantially level underside 22 and an upper side comprising a substantially horizontally disposed central section on which also the track supports 16 are formed, as well as roof sections 26, 28 to either side thereof inclined in a roof-like manner. Along the longitudinal sides of the sleepers both roof sections 26, 28 jointly merge into a channel section 130 comprising at its outer end over the entire length of the sleeper a rim 132 projecting upwardly in order to define the respective channel 134. In this manner the rainwater is drained off the sleepers via their inclined roof sections into the respective channels 134 and is laterally discharged therefrom.

Figure 3:
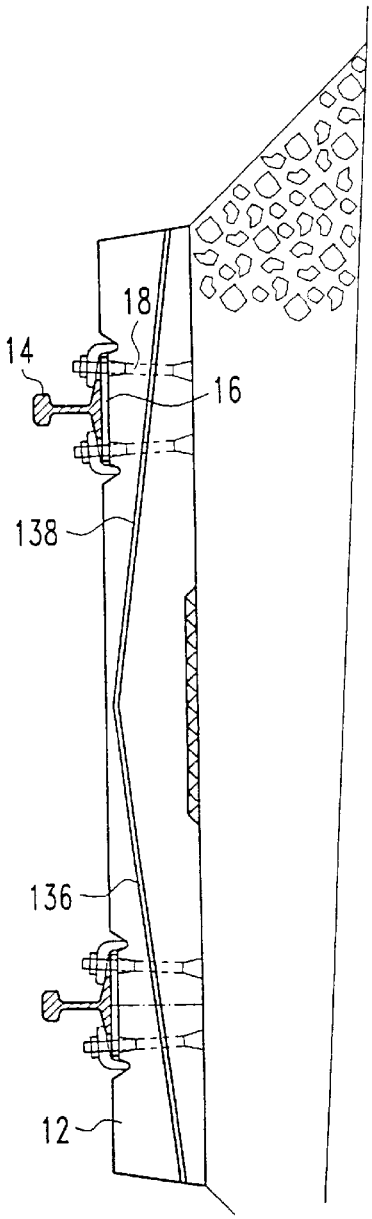
Figure 4:
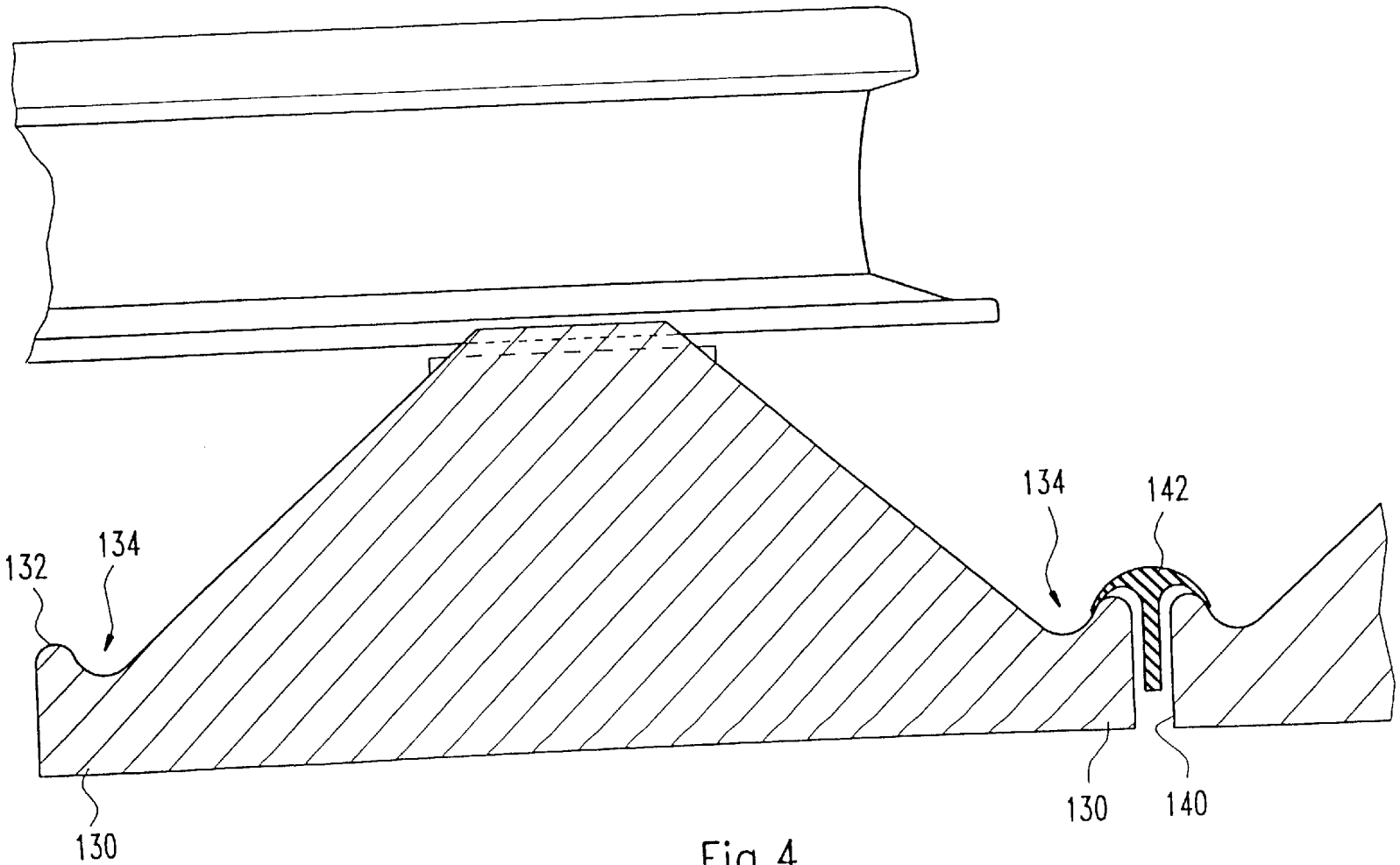
Figure 5:
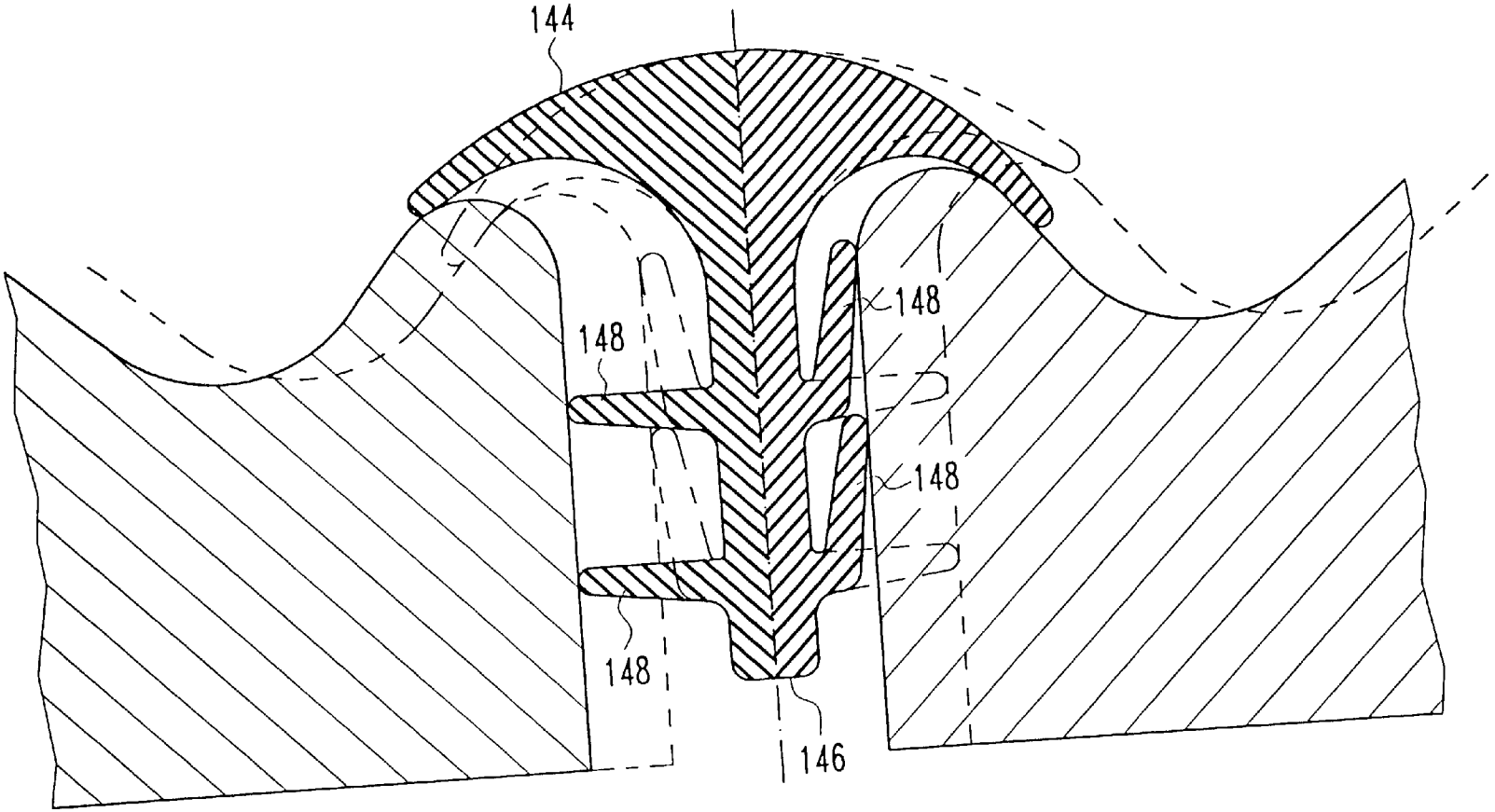
Figure 9:
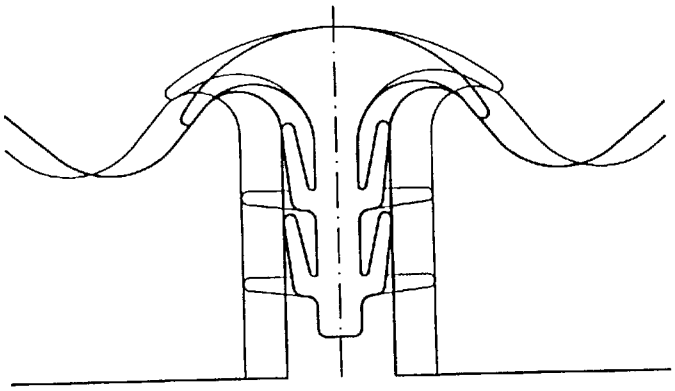
Figure 8:
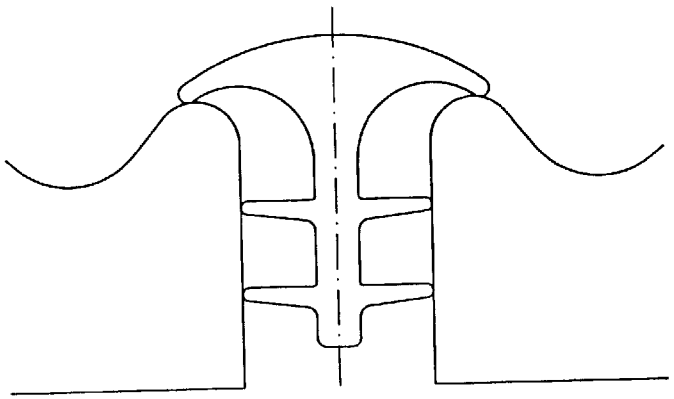
Figure 7:
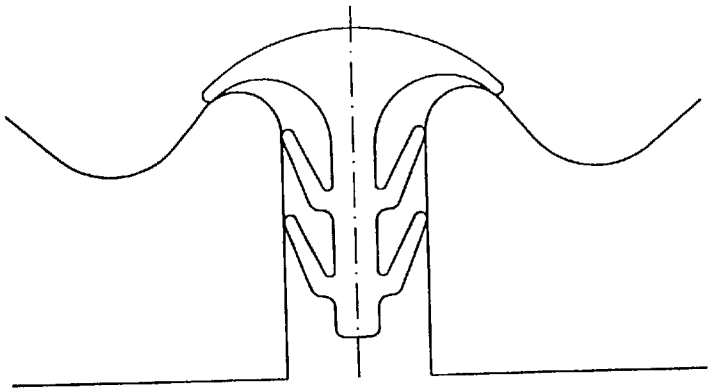
Figure 6:
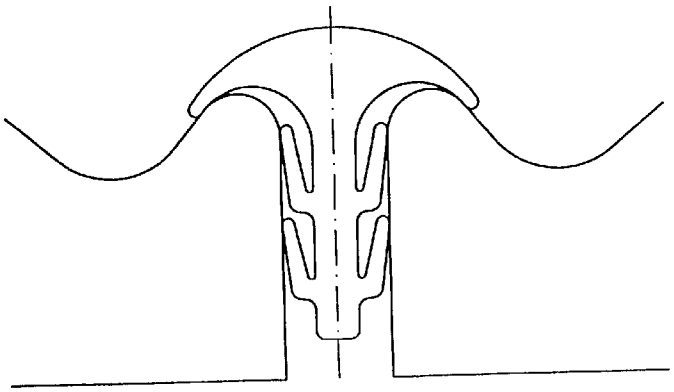

In order to ensure a speedy lateral water drainage, the drainage channels 134 are designed in ridge roof like manner comprising two oppositely inclined sections 136, 138, as can be seen in particular from FIG. 3, where the sections 136, 138 each slope towards the sleeper head, converging in the center of the sleeper.

In order to prevent water from entering the gap 140 between the individual sleepers, a covering element 142 is preferably provided which consists in particular of rubber or rubber-like, elastically deformable material. This overall fillet-like covering element 142 extends over the entire length of the gap, but might also be composed of a plurality of individual pieces adjoining or inter-engaging one another in a sealing or overlapping manner. In the case of the working example, the covering element 142 includes a roof section 144, more or less mushroom-like in cross-section, bearing with both sides on the upper regions of the channel sections 130 of adjoining sleepers as well as a foot section 146 projecting into the gap 140. The width of the roof section 144 is so selected as to reliably cover the gap 140 even in the event of the widest possible gap occurring in practical operation, as apparent from FIGS. 5 to 9. The upper side of the roof section 144 is convexly curved while the undersides of the roof section on both sides of the foot section 146 are curved concavely, merging into the foot section. The foot section 146 furthermore comprises anchoring elements 148 extending laterally, i.e. vertically to the plane of the foot section being elastically deformable, forming an integral part of the foot section and may be designed as continuous ledges or as isolated protrusions. The total width of the foot section 146 together with its non-deformed anchoring elements 148, measured in the direction of the gap width, at least equals the maximum gap width occurring in practice, being preferably somewhat greater than the latter. The thickness of the foot section, including the anchoring elements when deflected upwardly, equals at the most the minimum gap width occurring in practice.

The covering elements 142 are pressed from the top into the gaps between the individual sleepers until the roof section 144 comes to rest on the adjoining sleeper, the anchoring elements being deflected more or less in an upward direction depending on the gap width and taking care of the anchorage of the covering element 142 in the respective gap. Covering and anchoring takes place over the entire gap length, regardless of the actually prevailing gap width.

Figure 2:
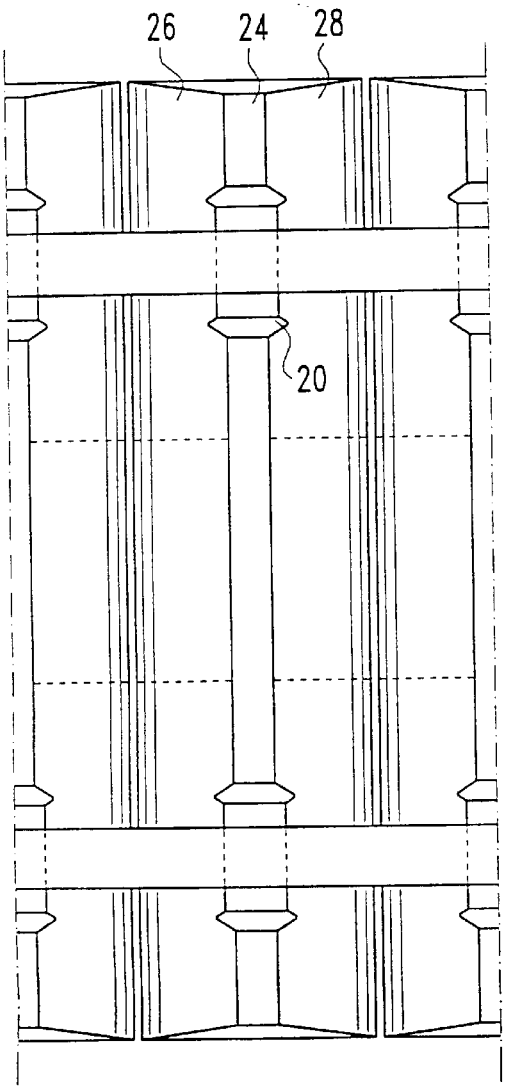
Figure 10:
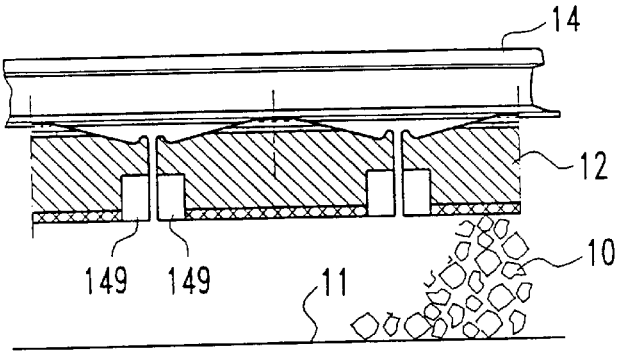
Figure 11:
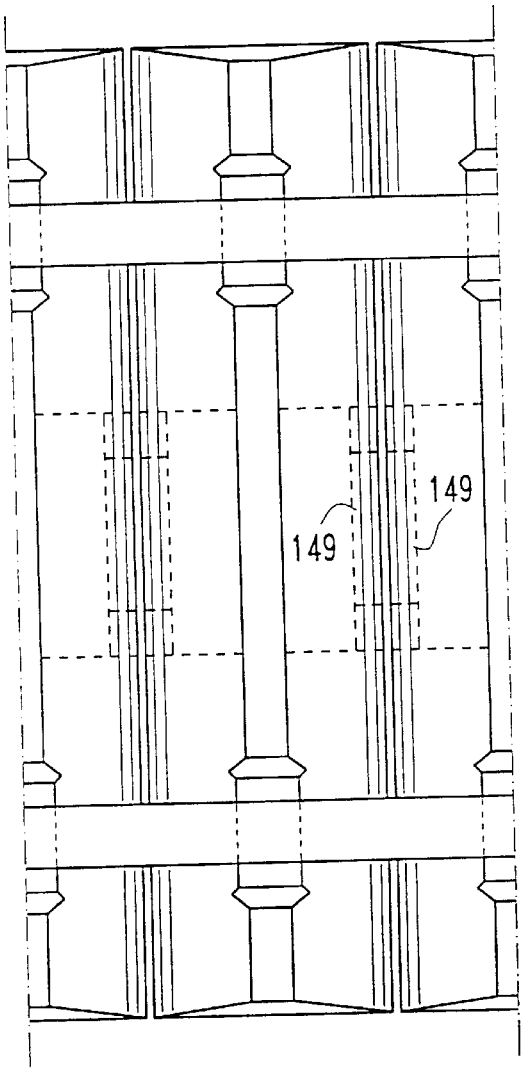
Figure 12:
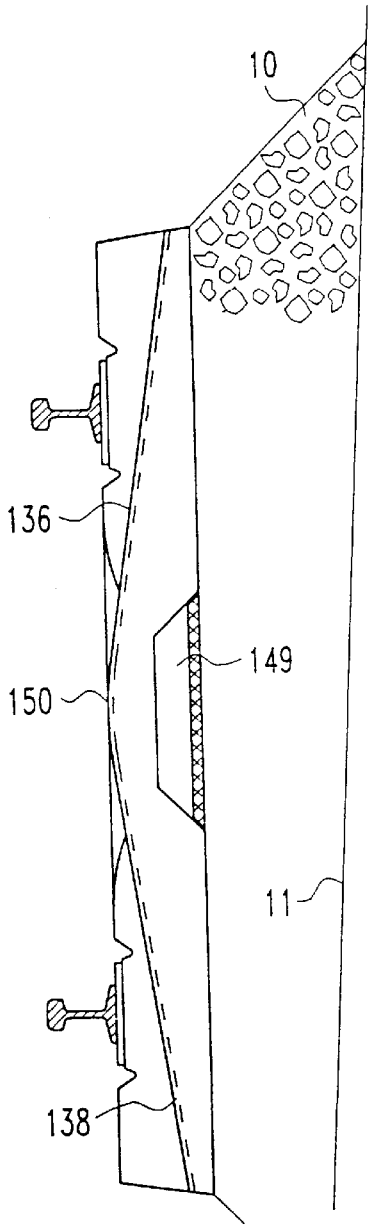
Figure 13:
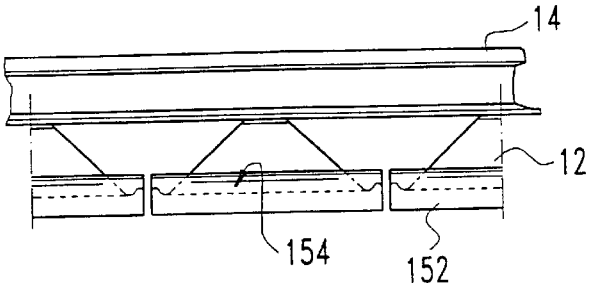
Figure 14:
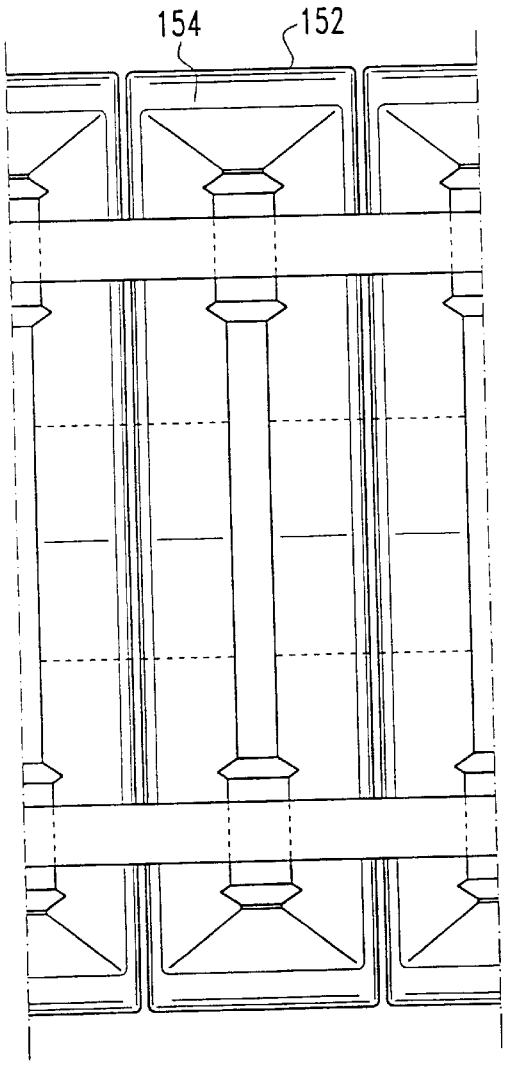
Figure 15:
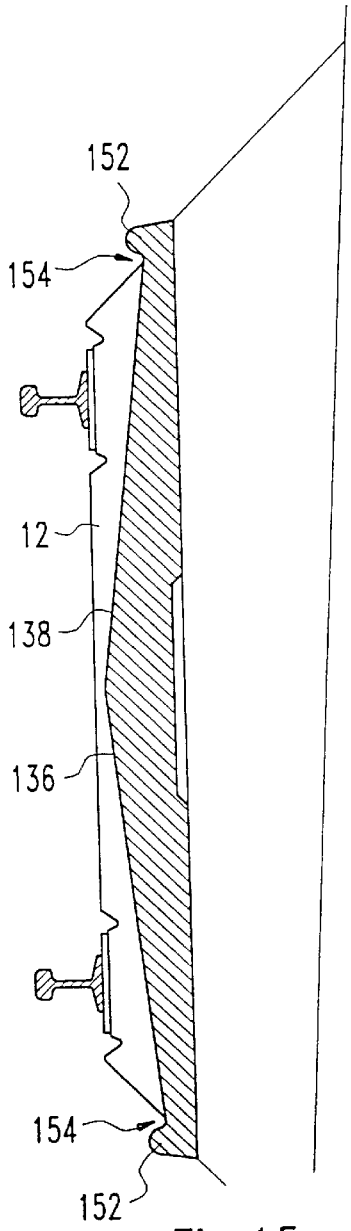
Figure 16:
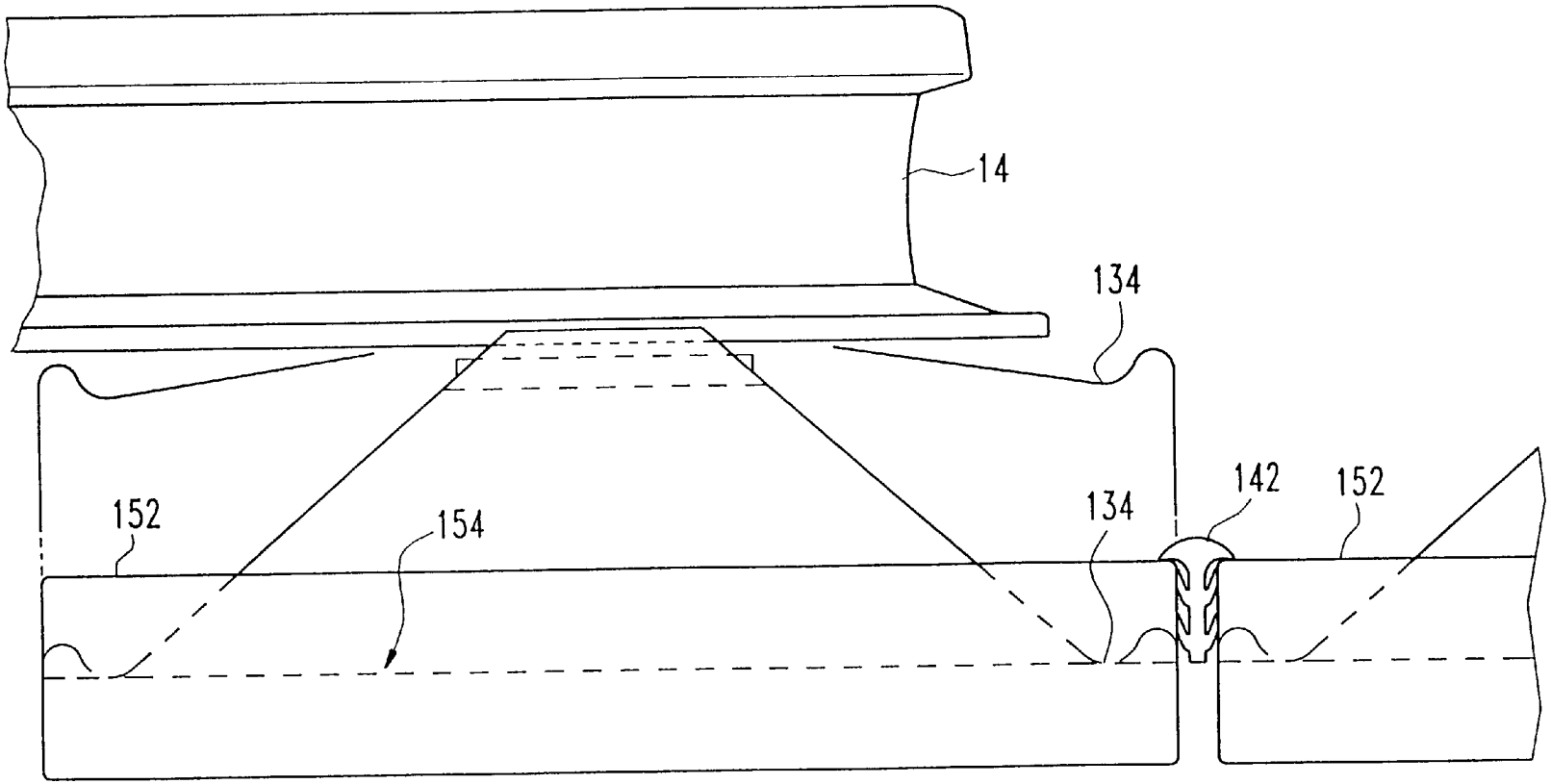
Figure 17:
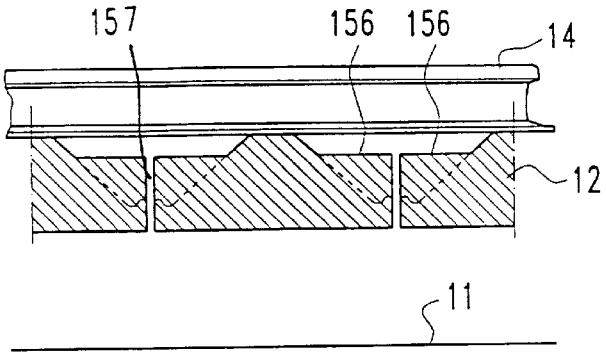
Figure 18:
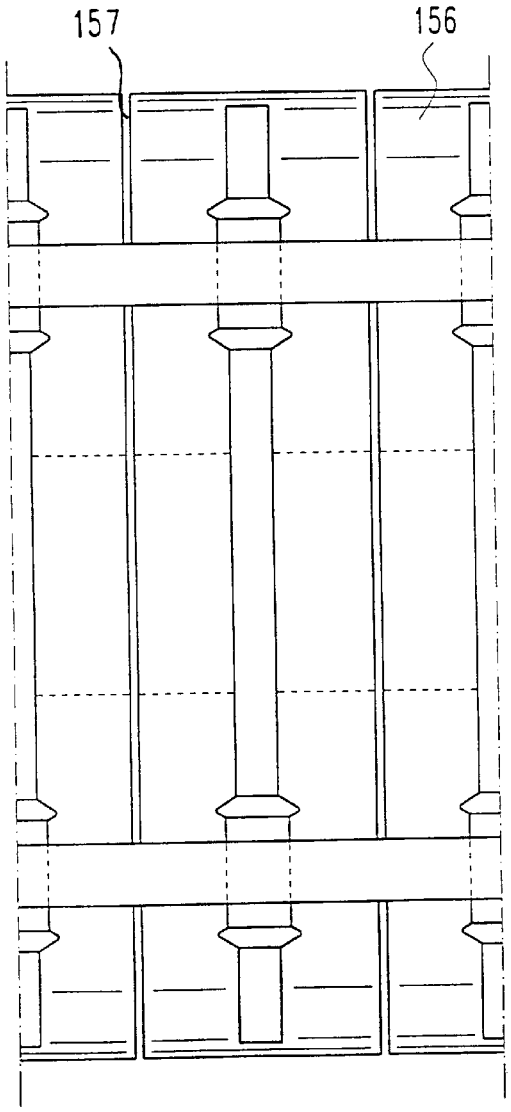
Figure 19:
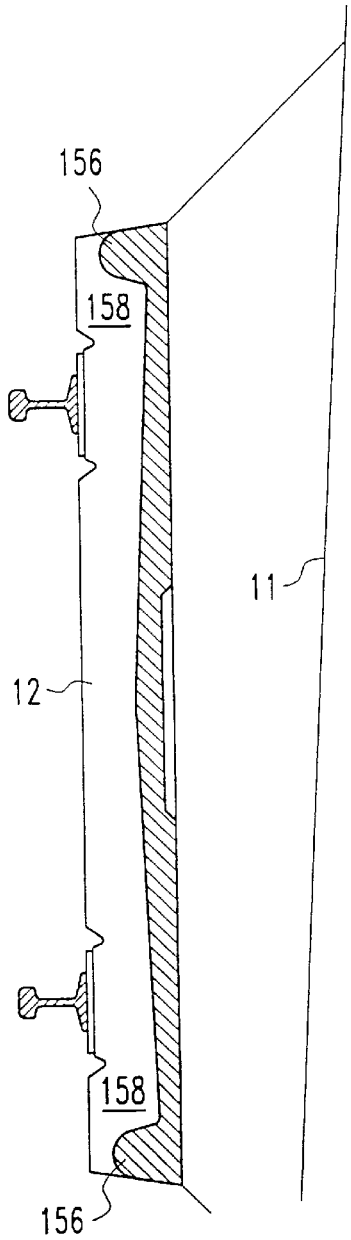
Figure 20:
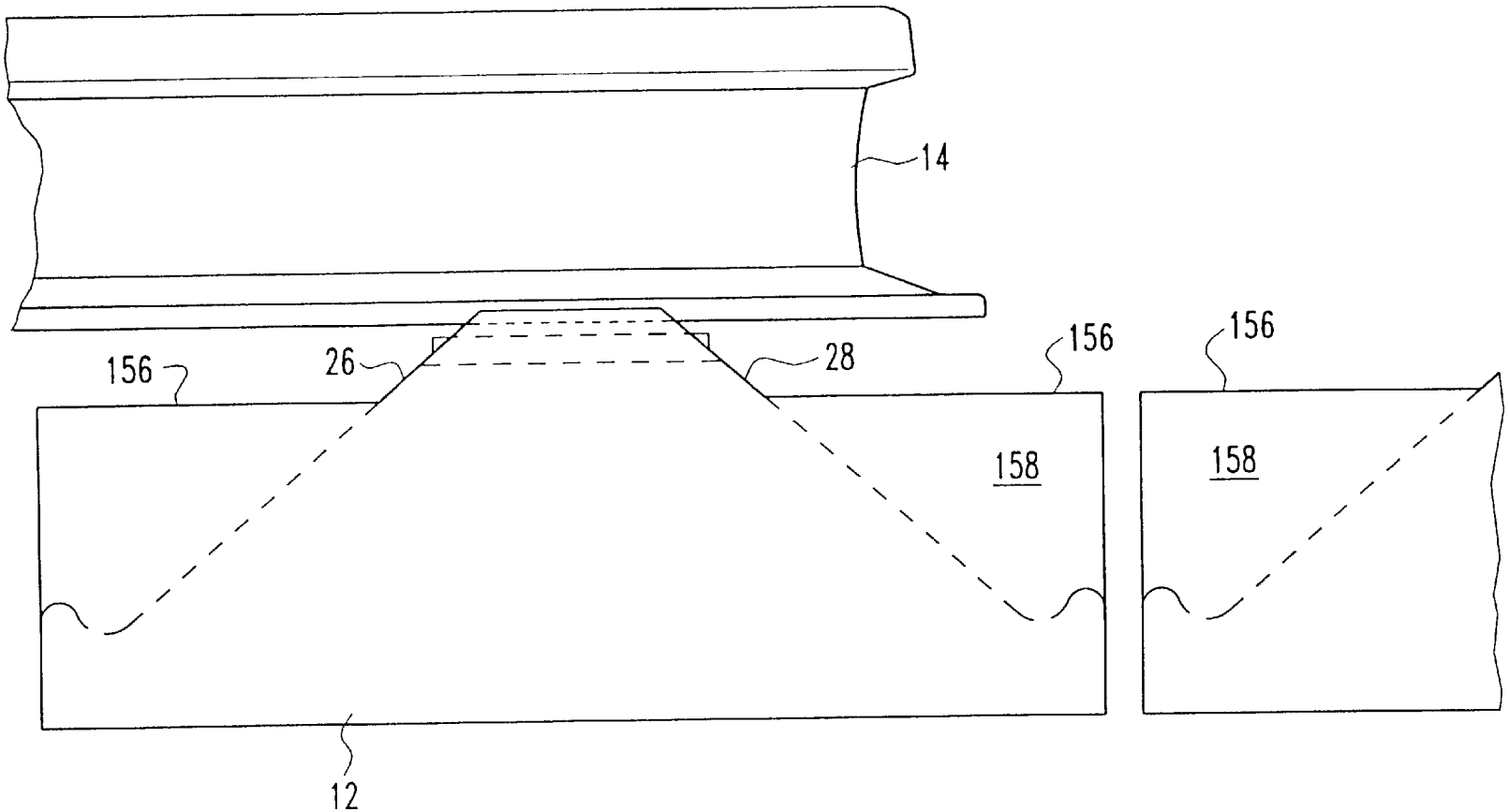

The working example according to FIGS. 10 to 12 substantially corresponds to the one according to FIGS. 1 to 3 so that a detailed description may be dispensed with in this respect. The gap between the individual sleepers may be covered or uncovered. The difference from the first mentioned working example resides in that in the present case a pocket 149, open towards the bottom is provided on each side of the lower longitudinal edges of the sleepers, the two pockets of any two adjoining sleepers facing one another, and in that the pockets, viewed in the longitudinal direction of the sleepers, are centrally disposed and extend merely over a central region of the sleeper. Such pockets 149, on the one hand, reduce the weight of the sleeper and on the other hand serve as buffer volume for the possible accommodation of ballast for tamping operations (during which in particular tamping is performed laterally from the sleeper heads towards the interior), in order to help avoid in this manner a possible "riding" of the sleepers on ballast material rising in the center of the track.

In the embodiment according to FIGS. 13 to 16 a longitudinal drainage, that is to say a drainage in the longitudinal direction of the track, is provided in addition to the transverse drainage. For this purpose further channel sections 152 are moulded onto the sleepers in the region of the sleeper heads on one side or on both sides, defining drainage channels 154 extending in the longitudinal direction of the track. The gaps between the sleepers are suitably covered or sealed in the region of these longitudinal drainage channels in order to define a continuous channel. In an alternative embodiment these sealing means are formed by covering elements sealing the entire gap extending in the longitudinal direction of the sleeper.

A further working example is illustrated in FIGS. 17 to 20. Here, upwardly pointing retaining walls 156 are formed on the sleeper face ends in the region of the drainage channels and the entire gap region 157 including the one between adjoining retaining walls is sealed in an appropriate manner (for example, in one of the manners discussed in detailed in connection with the other disclosed embodiments) so that a trough 158 is brought about between the roof sections 26, 28 and the retaining walls 154 in which rainwater may accumulate.

Figure 21:
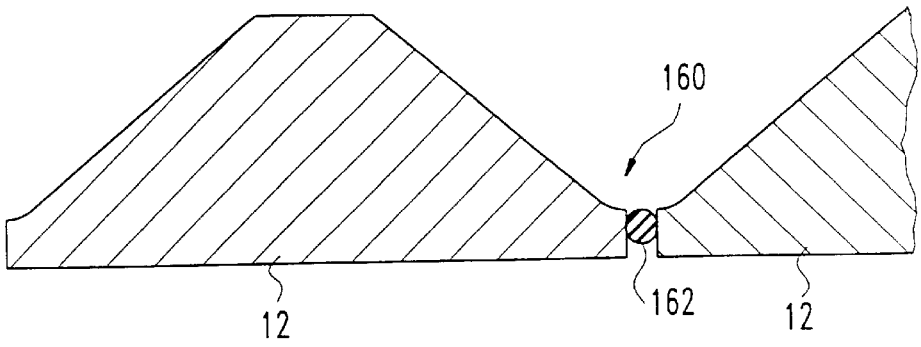

In a further embodiment, outlined in FIG. 21, two adjoining sleepers each form a single channel 160, in which case the gap between the sleepers is sealed by means of a sealing element 162. This single channel 160 may be inclined in one direction or, as described further above, may be inclined in roof-like manner in two directions and, if necessary, additional retaining walls or an additional longitudinal drainage means may be provided.

Figure 22:
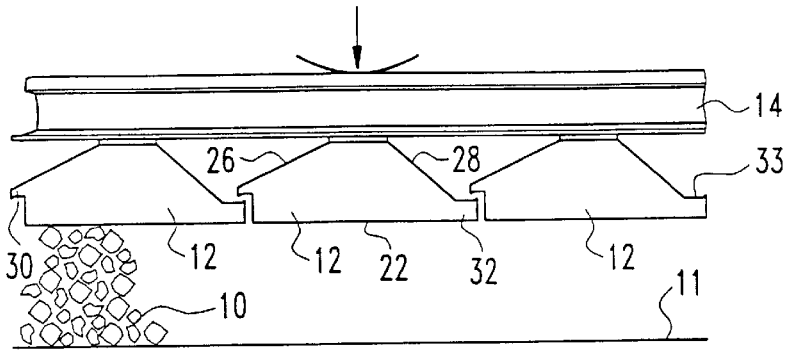
Figure 23:
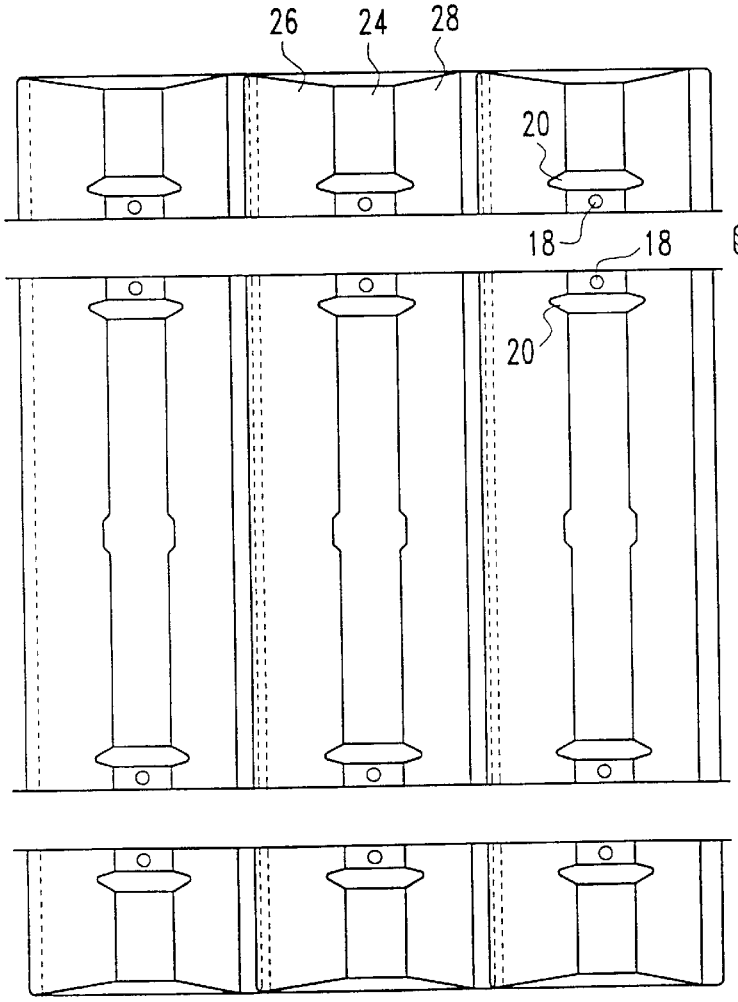
Figure 24:
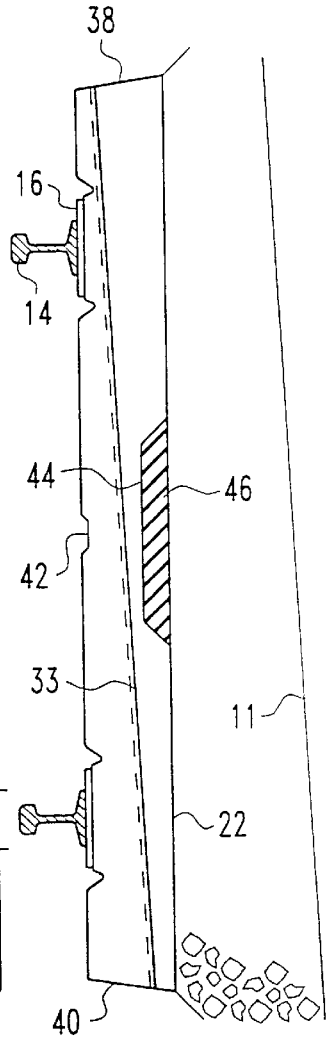
Figure 25:
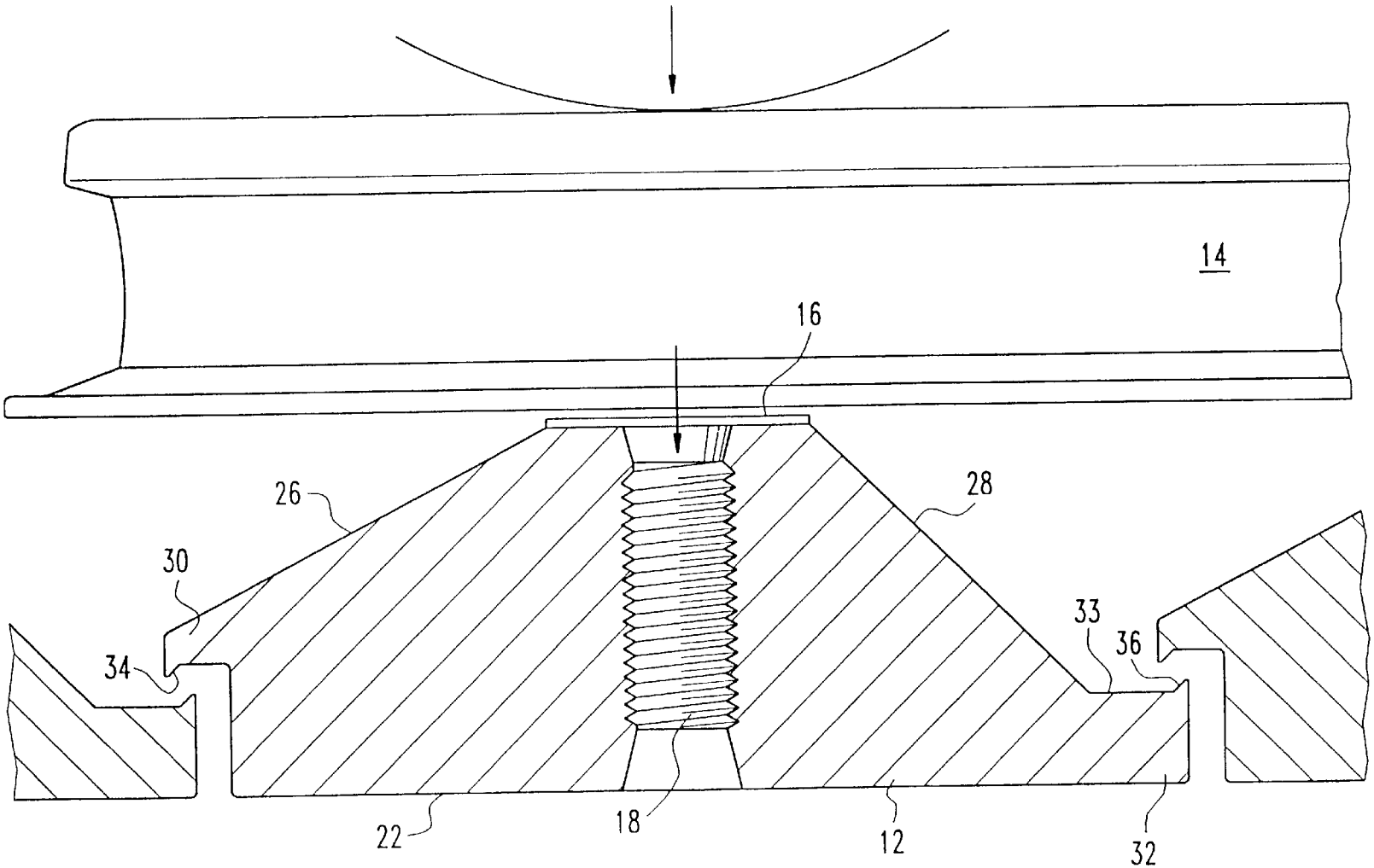

In the working example according to FIGS. 22 to 26 the sleepers overlap without mutual contact as can be seen in particular from FIGS. 22, 23 and 25. The roof section 26 passes into a free salient projection 30 while the roof section 28 on the opposite longitudinal side of the sleeper merges into a channel section 32. At the lower terminal edge of the projection 30 a dripping edge 34 is provided extending over the entire sleeper length, see FIG. 25, while the outer end of the channel section 32 over the entire length of the sleeper comprises an upwardly pointing rim 36 in order to define the channel 33.

When installed, the adjoining sleepers overlap each other in such a manner that the channel of a sleeper engages under the salient projection of the adjoining sleeper without touching it. In this manner the rainwater is directed from the sleepers via their oblique roof sections into the respective channels and is laterally discharged from there.

Figure 26:
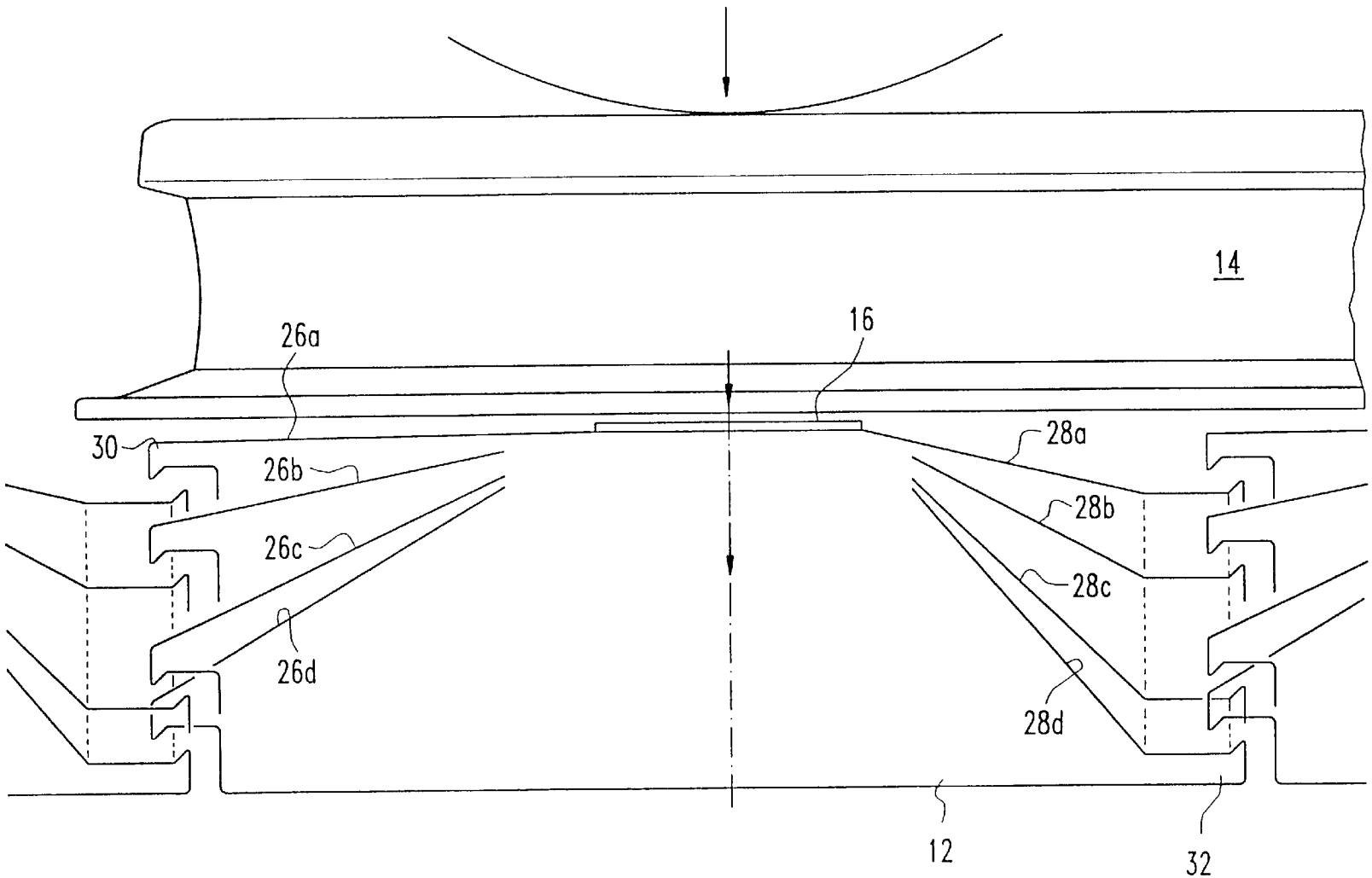

In order to ensure a speedy lateral water drainage, the channels or channel sections 32 are inclined in the longitudinal direction of the sleeper as is apparent in particular from FIG. 24. Accordingly the projections 30 of the sleepers 12 are likewise inclined, from which follows that the inclination of the roof sections 26, 28 from one head end 38 of the sleeper to the other head end 40 increases continuously. This situation is shown in FIG. 26 wherein several sections along the sleeper are indicated. The reference numerals 26*a* and 28*a* show the roof profile at the head end 38, the reference numerals 26*d* and 28*d* show the roof profile at the head end 40. The reference numerals 26*b*, 28*b*, and 26*c*, 28*c* show roof profiles thereinbetween.

FIGS. 23 and 24 further show a conduit passage 42, serving to accommodate a track conductor (not illustrated) provided centrally on the upper side of each sleeper in longitudinal direction of the sleeper and extending in the direction of the tracks. In addition, the recess 44 is apparent from FIG. 24, extending centrally on the sleeper underside 22, viewed in its longitudinal direction, and over the entire width of the sleeper, preventing "riding" of the sleeper and filled with an elastic plastics material 46, as illustrated.

Figure 27:
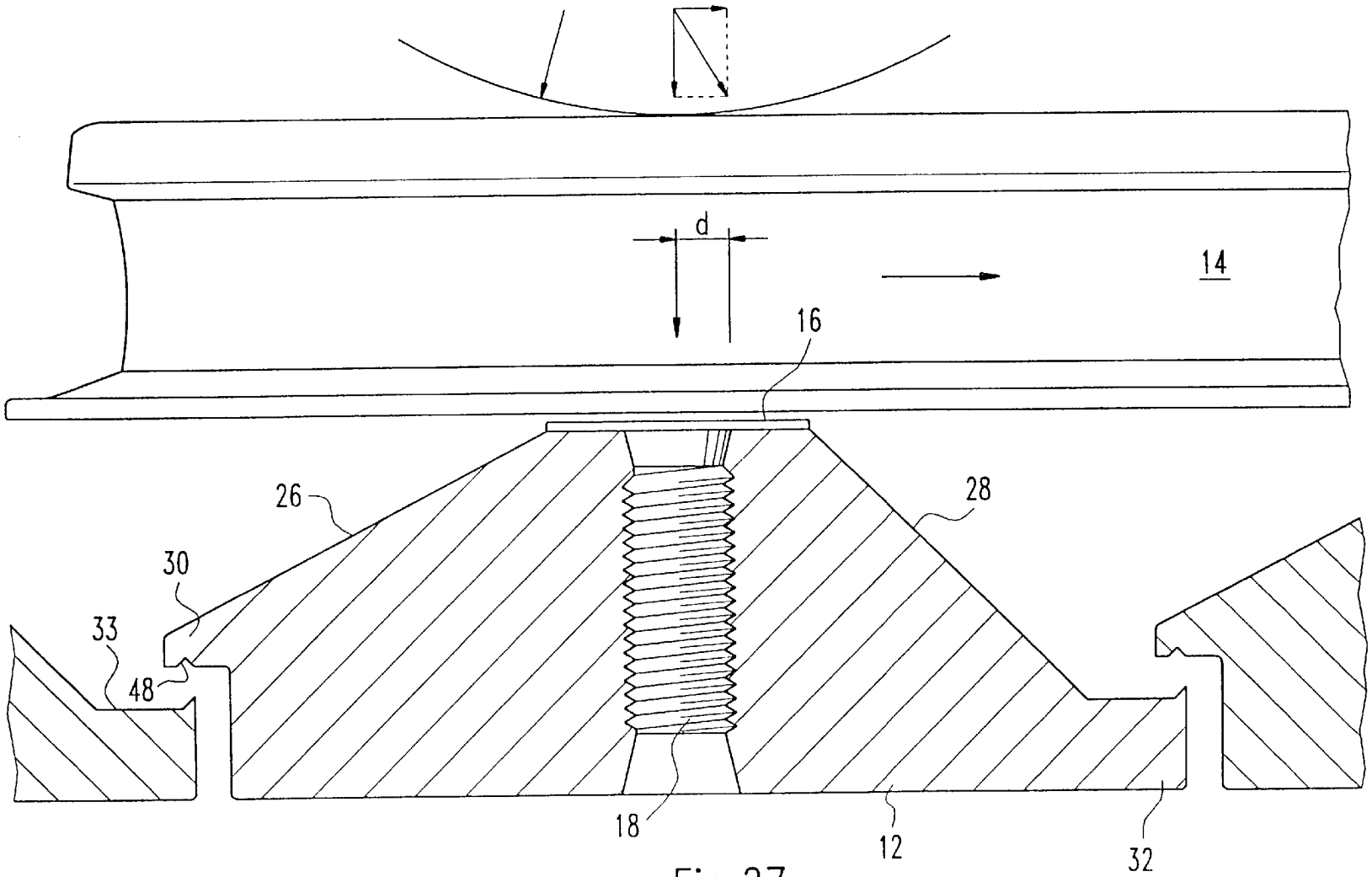

The working example according to FIG. 27 substantially corresponds to the one according to FIGS. 22 to 26 so that a detailed description is dispensed with in this respect. The difference is that in the case of the working example according to FIG. 27 instead of the dripping edges 34 at the lower end of the salient projection a groove 48 is now provided ensuring that the water running off the roof section 26 reaches the passage 33 of the passage section 32 and does not for example seep along the side wall of the sleeper, entering the ballast bed.

In addition, in the case of the working example according to FIG. 27, the track supports 16 are no longer positioned centrally but are rather shifted rearwardly by the distanced opposite to the direction A in which the track is traveled on. Such off-centering of the support takes effect in a direction-bound (dual-tracked) railway and allows for the dynamics of vehicle movements so that loading of the sleeper becomes more balanced.

Figure 28:
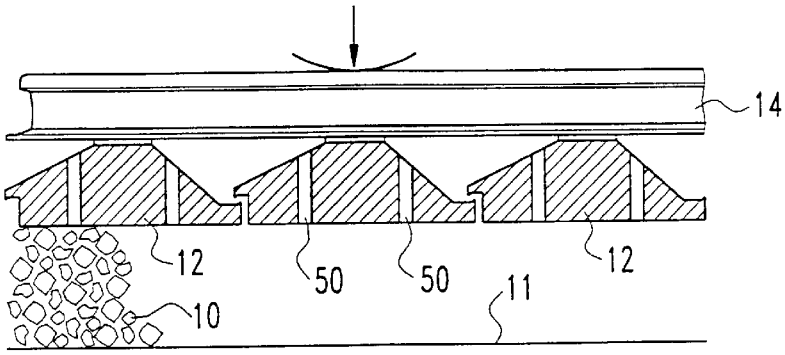
Figure 29:
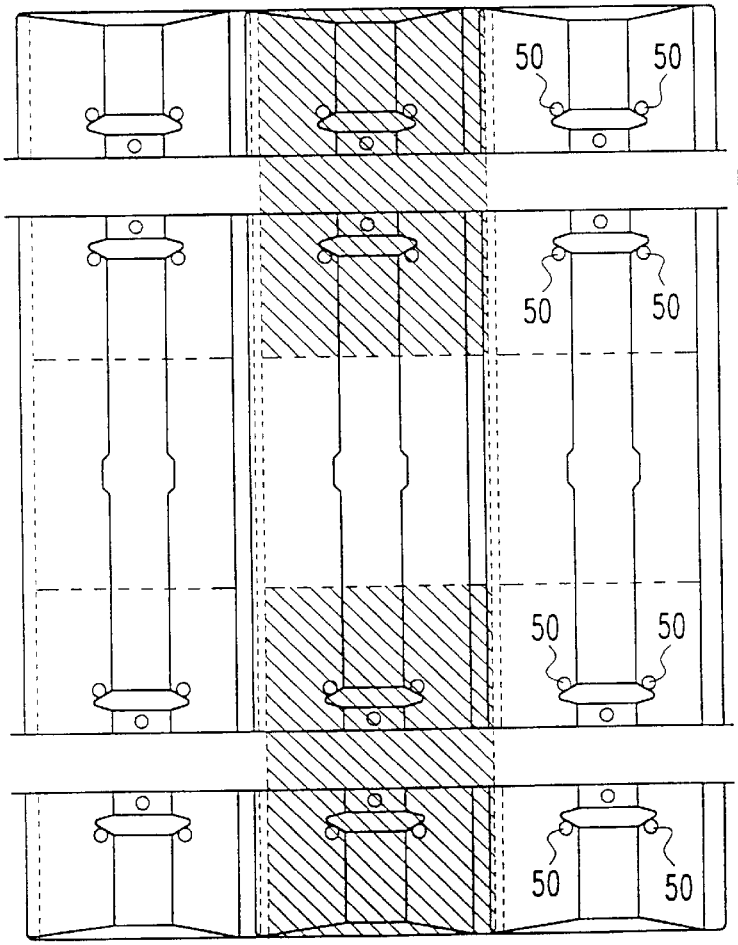
Figure 30:
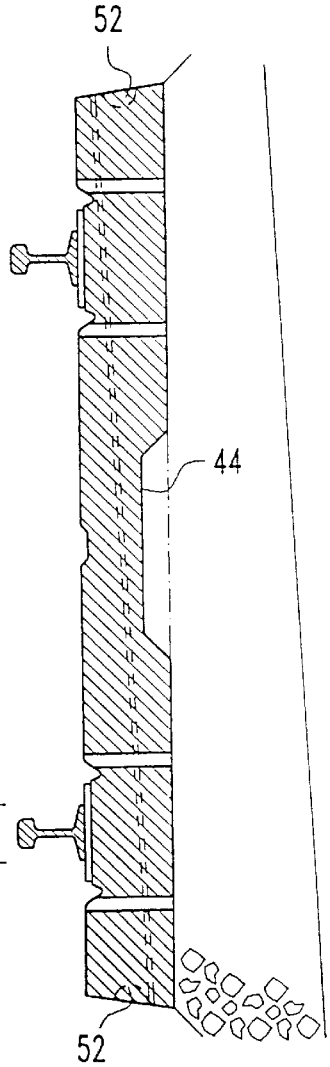

The working example according to FIGS. 28 to 30 in turn substantially corresponds to the one according to FIGS. 22 to 26 with the following exceptions: Additionally filling apertures 50 are provided via which, in particular for the tamping procedure, additional material may be introduced into the ballast bed. The filling apertures 50 are provided in the region in particular close to the track supports 16. Moreover, recesses 52 are formed in both sleeper heads of each sleeper, facing one another which are particularly useful for lifting the sleepers during tamping or for assembly purposes.

Figure 31:
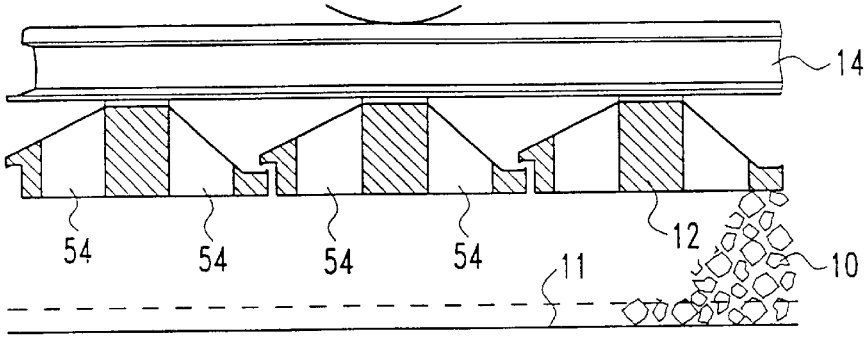
Figure 32:
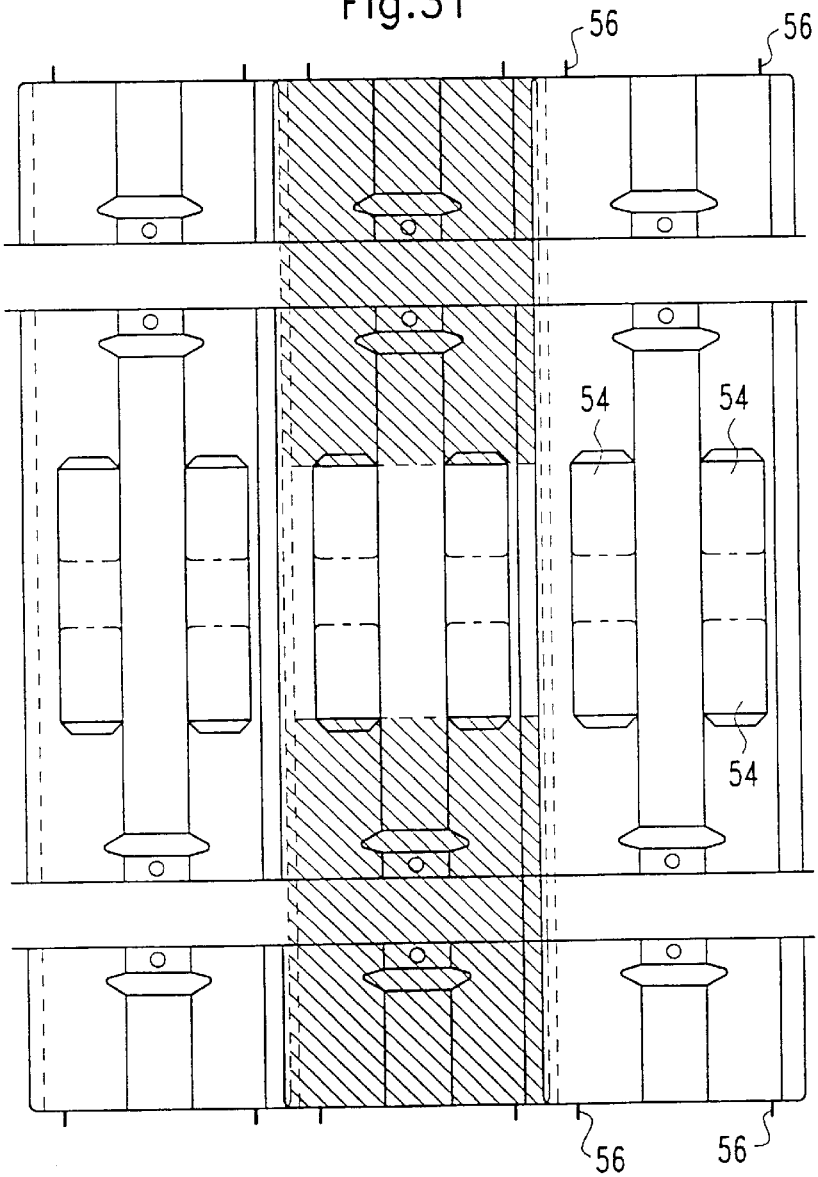
Figure 33:
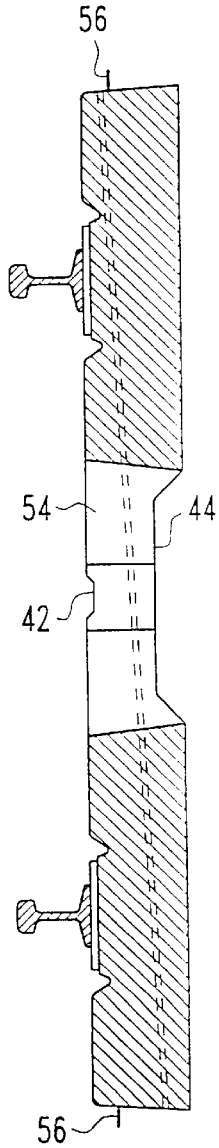

The further working example according to FIGS. 31 to 33 in turn substantially corresponds to the one according to FIGS. 22 to 26 with the following exceptions: The sleepers additionally comprise tamping apertures 54 through which suitable tamping tools such as tamping picks may be inserted into the ballast structure in order to tamp underneath the sleeper in particular in the region of the track axis. The tamping apertures are disposed in pairs on opposite sides of the remaining central web in which the prestressing steels are to be found. The tamping apertures 54 are in particular situated in the region of the recess 44, which in this case lacks a synthetic resin filling. Furthermore, in this working example the reference numerals 56 denote reinforcing rod spacers which protrude from the sleeper heads and which, for example, may serve to mount sound protection walls extending over the sleepers. Instead of the reinforcing rod spacers 56 suitable mounting sleeves or the like may, of course, likewise be cast into the sleeper heads.

Figure 34:
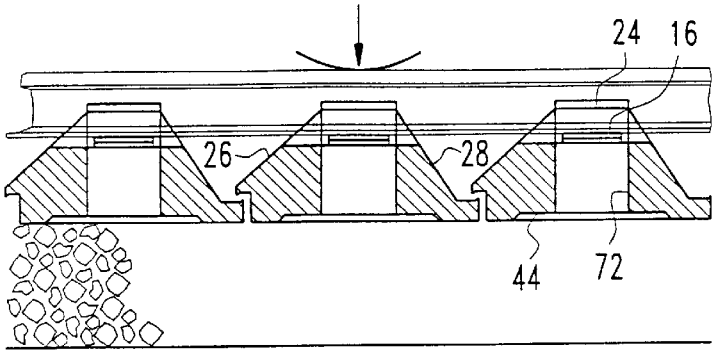
Figure 35:
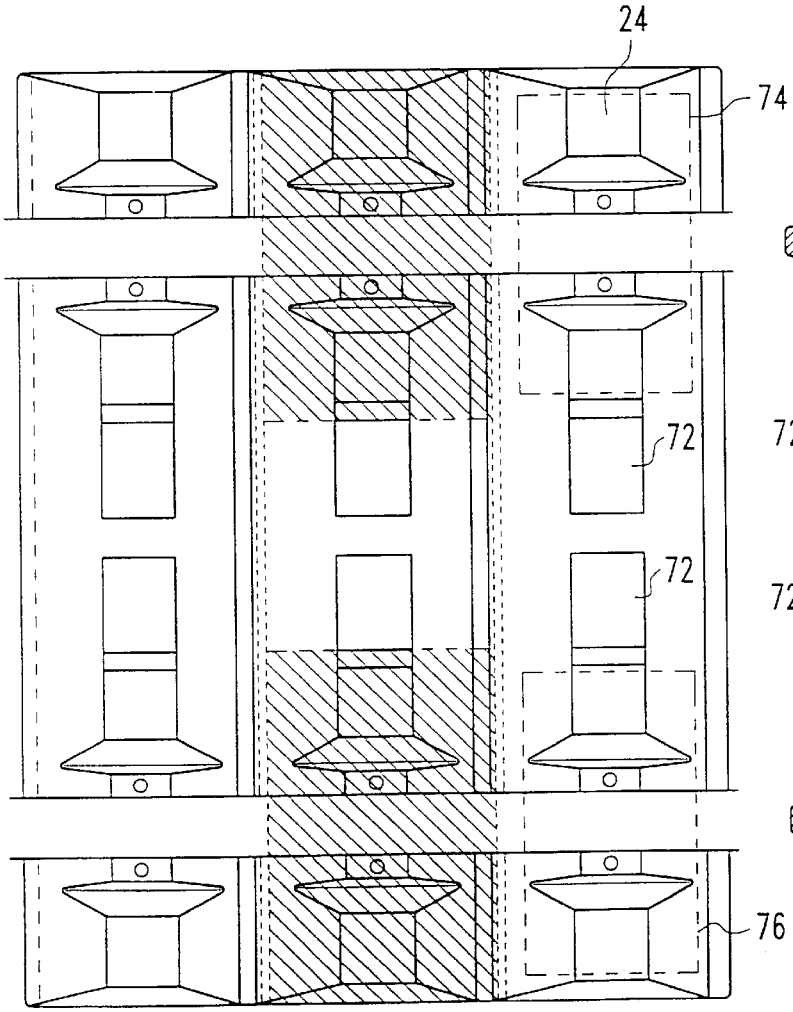
Figure 36:
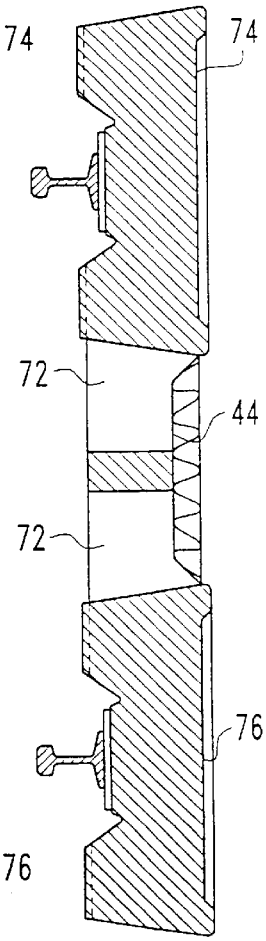

The further working example according to FIGS. 34 to 36 in turn substantially corresponds to the one according to FIGS. 22 to 26 with the following exceptions: The sleepers 12 each comprise two tamping apertures 72 which, viewed in the longitudinal direction of the sleeper, are disposed centrally, facing one another in pairs in relation to the longitudinal axis of the track. These tamping apertures 72 may be designed relatively wide so that a wider tamping tool (pick) may be used, making filling easier. It may be mentioned that the tamping apertures 72 are provided in the region of the recess 44, that is to say the zone which does not bear the track support.

Furthermore in the case of this working example the upper side of the sleeper, that is to say the central section 24, is clearly raised in relation to the working examples described further above, while the position of the track supports 16 remains the same. This results in that, due to the greater height of the sleepers, a larger transverse gradient of the drainage channel may be attained so that the lateral drainage towards the field side is possible even in the event of very considerable track superelevations, that is to say against the sleeper inclination.

In addition, in the case of this working example, additional cavities 76 are provided on the underside of the sleeper on both sides of the recess 44, thus creating additional adjustment facilities (e.g. sand injection), the sleeper being able to absorb greater transverse and longitudinal forces and furthermore attaining a weight reduction.

The sleeper illustrated in FIGS. 34 to 36 has the additional advantage that it is stackable, in which context the individual sleepers lie one on top of the other in form-fitting manner thus simultaneously ensuring secure transport.

Figure 37:
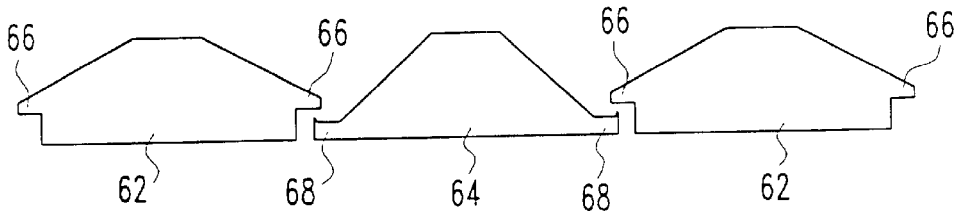

In the working example according to FIG. 37 two types of sleepers 62, 64 are provided. The sleepers 62 comprise free salient projections 66 on both sides and the sleepers 64 comprise channel sections 68 on both sides, the sleepers 62 and 64 being disposed alternately and the channel sections engaging underneath the respectively associated projections 66.

Figure 38:
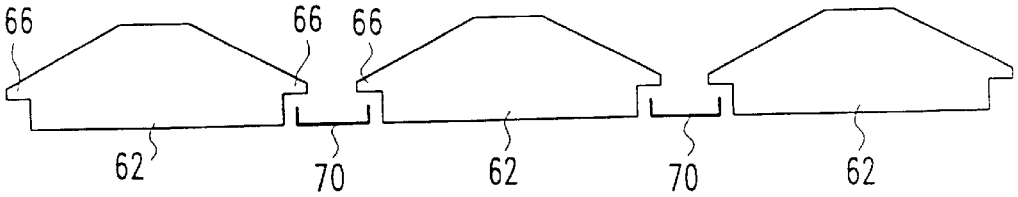

In the working example according to FIG. 38 the sleepers 62 having salient projections 66 on both sides, are disposed side by side but leaving a gap. Between any two adjoining sleepers 66 a gutter 70 each is provided defining a drainage channel, in which context the gutter 70 engages underneath both opposite projections 66 of adjoining sleepers 62. In this working example additional tamping apertures are superfluous, as after the removal of the gutters 70 the tamping tools may be inserted into the ballast through the gap between adjoining sleepers. The gutters 70 may in principle be designed even longer than the sleepers, thus projecting beyond the sleeper length thereby further facilitating water drainage. In the case of this working example the gutters may likewise be provided with a gradient.

It follows that the features described and illustrated in the aforegoing by way of the different working examples may be provided in substantially any desired combination in a single sleeper.

When performing the present invention diverse advantages are attained:

As already discussed further above, the lateral surface water drainage results in a reduced softening of the substructure, a drastic reduction of the surface soiling so that in this respect cleaning work, previously necessary, may be dispensed with, and the prevention of plant growth so that the use of herbicides, harmful to the environment, or mechanical plant removal are no longer necessary further resulting in an altogether greater positional stability of the track.

Because of the substantially increased supporting surface of the sleepers on the ballast as compared with a conventional transverse sleeper track, a substantially reduced surface pressure (approximately halt) between the sleeper underside and the ballast is attained, resulting in a longer life of the track, reduced ballast loads as well as preservation of the elasticity of the ballast bed.

Because of the higher weight and the larger sleeper head surface areas in addition a substantially increased cross motion resistance of the sleepers is brought about and therefore a better absorption of the stresses within the track. The resistance to transverse displacement is further enhanced by the recesses 44 on the sleeper underside as well as by other apertures, terminating on the sleeper underside.

What is claimed is:

1. A railway track, comprising:

a ballast bed;

sleepers disposed on the ballast bed and being separated from each other by a first distance;

tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, and wherein at least one drainage channel, extending transversely to the longitudinal direction of the tracks, is assigned to each sleeper for lateral water drainage; and a gap cover covering or sealing the gap from a top side thereof, wherein the gap cover is adhesively bonded in, or in the region of the gap.

2. Railway track according to claim 1, wherein the drainage channels form an integral part of the sleepers.

3. Railway track according to claim 1, wherein the drainage channels are inclined in a longitudinal direction of the sleepers.

4. Railway track according to claim 3, wherein the drainage channels are designed in ridge-roof fashion with two oppositely inclined sections.

5. Railway according to claim 1, wherein upper sides of the sleepers are at least partly inclined in the longitudinal direction of the tracks.

6. Railway track according to claim 1, wherein each sleeper along each of its opposite longitudinal sides in each case comprises a drainage channel extending transversely to the longitudinal direction of the tracks.

7. Railway track according to claim 1, wherein the sleepers have tamping apertures opposing one another in pairs.

8. Railway track according to claim 1, wherein the sleepers have continuous filling apertures provided in the sleeper.

9. Railway track according to claim 1, wherein the sleepers are formed substantially of concrete and include at least one cavity filled with a material lighter than concrete.

10. Railway track according to claim 1, wherein each sleeper has a duct passage thereon or therein, extending in the longitudinal direction of the tracks.

11. Sleeper for a railway track according to claim 1, wherein the sleeper has at least one feature selected from the group of features consisting of the drainage channels forming an integral part of the sleepers;

the drainage channels being inclined in the longitudinal direction of the sleepers;

the drainage channels being designed in ridge-roof fashion with two oppositely inclined sections;

the upper sides of the sleepers being designed at least partly inclined in the longitudinal direction of the tracks;

each sleeper along each of its opposite longitudinal sides in each case comprising a drainage channel extending transversely to the longitudinal direction of the tracks;

a joint drainage channel is in each case being assigned to two adjoining sleepers;

adjoining sleepers overlapping in the longitudinal direction of the tracks without mutual contact and that the drainage channel in the region of the overlap preferably forming an integral part of one of the adjoining sleepers;

each sleeper along its one longitudinal side comprising a salient projection and along its opposite longitudinal side a laterally projecting channel section forming the drainage channel, in which context the channel section engages underneath the salient projection of the adjoining sleeper;

at the end of the salient projections along their underside a drip section being designed, formed in particular by a downwardly pointing drip ledge or by an upwardly facing groove;

tamping apertures being provided in the sleepers opposing one another in pairs;

continuous filling apertures being provided in the sleepers;

on the undersides of each sleeper at least one recess being centrally disposed and extending over the entire sleeper width and which is filled with synthetic resin material;

at least one depression or projection being provided on the sleeper heads;

the sleepers consisting substantially of concrete and including at least one cavity filled with a material lighter than concrete;

a duct passage extending in longitudinal direction of the tracks being provided on or in the sleepers;

track supports of the sleepers being disposed off-center in relation to a longitudinal-central plane of the sleepers;

sleeper surfaces being provided at least in part with sound absorbing or sound refracting means;

the sleepers consisting of concrete having a non-prestressed reinforcement and/or a prestressed reinforcement;

a groove being provided along an upper edge of the sleeper heads;

the drainage channel, at a sleeper face end, exiting into a further drainage channel extending in the longitudinal direction of the tracks;

the further drainage channel at each sleeper head forming an integral part of the sleepers; and the drainage channel at the sleeper face end comprising an upwardly directed retaining wall.

12. A railway track, comprising:

a ballast bed;

sleepers disposed on the ballast bed and being separated from each other by a first distance;

tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, and wherein at least one drainage channel, extending transversely to the longitudinal direction of the tracks, is assigned to each sleeper for lateral water drainage; and a gap cover covering or sealing the gap from a top side thereof, wherein the gap cover in cross-section includes a mushroom-shaped roof section that covers the gap with a section of the sleepers bordering thereon, the gap cover further comprising a foot section projecting downwardly into the gap, which is held in the gap in a press-fitting or form-fitting relationship.

13. Railway track according to claim 12, further comprising resiliently deformable holding means at the foot section which is adaptable to the respective gap width.

14. Railway track according to claim 13, wherein the holding means are expansion elements extending transversely to the gap.

15. A railway track, comprising:

a ballast bed;

sleepers disposed on the ballast bed and being separated from each other by a first distance;

tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, and wherein at least one drainage channel, extending transversely to the longitudinal direction of the tracks, is assigned to each sleeper for lateral water drainage; and a gap cover covering or sealing the gap from a top side thereof, wherein the gap cover is comprised of rubber or synthetic material.

16. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein a joint drainage channel is in each case assigned to two adjoining sleepers.

17. Railway track according to claim 16, further comprising a gap cover covering or sealing the gap from a top side thereof.

18. Railway track according to claim 17, wherein the gap cover is provided in a form-fitting or press-fitting relationship in the gap.

19. Railway track according to claim 17, wherein the gap cover comprises a cover element or sealing element bearing on adjoining one of the sleepers on or adjoining either side of the gap.

20. Railway track according to claim 16, wherein the two adjoining sleepers overlap in the longitudinal direction of the tracks without mutual contact and the drainage channel in the region of the overlap forms an integral part of one of the two adjoining sleepers.

21. Railway track according to claim 20, wherein each sleeper comprises a salient projection along one longitudinal side thereof, and a laterally projecting channel section forming the drainage channel along an opposite longitudinal side thereof, in which context the channel section of one of the two adjoining sleepers engages underneath the salient projection of the other one of the two adjoining sleepers.

22. Railway track according to claim 21, further including a drip section at ends of the salient projections along the underside of the salient projections, formed by a downwardly pointing drip ledge or by an upwardly facing groove.

23. Railway track according to claim 20, wherein the sleepers include sleepers of a first type and sleepers of a second type, which alternate with each other, and wherein each sleeper of the first type comprises a salient projection along its two opposite sides and each sleeper of the second type along its two opposite sides comprises a laterally projecting channel section forming the drainage channel, in which context each passage section engages under the salient projection of the adjoining sleeper.

24. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein an underside of each sleeper has at least one centrally disposed recess extending over the entire sleeper width and filled with synthetic resin material.

25. Railway track according to claim 1, wherein the sleepers have sleeper heads which are each provided with at least one depression or projection.

26. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein said sleepers have track supports, disposed off-center in relation to a longitudinal-central plane of the sleepers.

27. A railway track, comprising:

a ballast bed;

sleepers disposed on the ballast bed and being separated from each other by a first distance;

tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, and wherein at least one drainage channel, extending transversely to the longitudinal direction of the tracks, is assigned to each sleeper for lateral water drainage; and means, on surfaces of the sleepers for absorbing or refracting sound.

28. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein the sleepers consist of concrete having a non-prestressed reinforcement and/or a prestressed reinforcement.

29. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein the sleepers include sleeper heads having upper edges provided therealong with a groove.

30. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein the drainage channel that extends transversely to the longitudinal direction of the tracks exits into a further drainage channel, the further drainage channel extending in the longitudinal direction of the tracks.

31. Railway track according to claim 30, wherein each sleeper has a sleeper head and the further drainage channel is located on the sleeper head and forms an integral part of the sleeper.

32. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein each sleeper has a sleeper face end and the drainage channel comprises an upwardly directed retaining wall at the sleeper face end.

33. A railway track, comprising:

a ballast bed;

sleepers disposed on the ballast bed and being separated from each other by a first distance; and tracks mounted on the sleepers, wherein the first distance of separation between the sleepers defines a second distance between supporting points of the tracks, wherein the sleepers are disposed in the longitudinal direction of the tracks, closely adjoining one another, but without mutual contact and leaving a gap, wherein at least one drainage channel, extending transversely to the longitudinal direction of the tracks, is assigned to each sleeper for lateral water drainage, and wherein the gap is sealed and adjoining sleepers amongst one another define a joint drainage channel extending transversely to the longitudinal direction of the tracks for lateral water drainage.

* * * * *